US009865221B2

(12) United States Patent
Li et al.

(10) Patent No.: US 9,865,221 B2
(45) Date of Patent: Jan. 9, 2018

(54) VOLTAGE REGULATION CIRCUIT AND LIQUID CRYSTAL DISPLAY COMPRISING THE SAME

(71) Applicants: SHENZHEN CHINA STAR OPTOELECTRONICS TECHNOLOGY CO., LTD., Shenzhen, Guangdong (CN); WUHAN CHINA STAR OPTOELECTRONICS TECHNOLOGY CO., LTD., Wuhan, Hubei (CN)

(72) Inventors: Man Li, Guangdong (CN); Xiaoping Tan, Guangdong (CN); Zhenzhou Xing, Guangdong (CN)

(73) Assignees: SHENZHEN CHINA STAR OPTOELECTRONICS TECHNOLOGY CO., LTD., Shenzhen (CN); WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 272 days.

(21) Appl. No.: 14/890,168

(22) PCT Filed: Sep. 8, 2015

(86) PCT No.: PCT/CN2015/089101

§ 371 (c)(1),
(2) Date: Nov. 10, 2015

(87) PCT Pub. No.: WO2017/031786

PCT Pub. Date: Mar. 2, 2017

(65) Prior Publication Data

US 2017/0186396 A1 Jun. 29, 2017

(51) Int. Cl.
*G09G 3/36* (2006.01)

(52) U.S. Cl.
CPC ..... *G09G 3/3696* (2013.01); *G09G 3/3648* (2013.01); *G09G 2310/0289* (2013.01); *G09G 2320/0209* (2013.01)

(58) Field of Classification Search
CPC ..... G09G 3/3696; G09G 3/3648; G09G 2310/0289; G09G 2320/0209
See application file for complete search history.

(56) References Cited

U.S. PATENT DOCUMENTS

2005/0146225 A1* 7/2005 Yamamoto ..... G09G 3/3655 307/72
2006/0164371 A1* 7/2006 Nakamura ..... G09G 3/3655 345/98

* cited by examiner

*Primary Examiner* — Sejoon Ahn
(74) *Attorney, Agent, or Firm* — Soroker Agmon Nordman

(57) ABSTRACT

A voltage regulation circuit is provided, including a reverse processing module for processing a first initial voltage of a common voltage generating module so as to obtain a reverse voltage of AC voltage; and an integration module for regulating the first initial voltage according to the reverse voltage of the AC voltage so as to make a liquid crystal drive voltage equal to a preset value. The liquid crystal drive voltage is a difference value of between a second initial voltage and the first initial voltage which is regulated.

2 Claims, 3 Drawing Sheets

VOLTAGE REGULATION CIRCUIT AND LIQUID CRYSTAL DISPLAY COMPRISING THE SAME

FIELD OF THE INVENTION

The present invention relates to the field of display devices, and more particularly to a voltage regulation circuit.

BACKGROUND OF THE INVENTION

FIG. 1 is a structural diagram showing one pixel of a liquid crystal display (LCD) panel. As shown on FIG. 1, a drain of a thin film transistor is connected with a data line 11, a gate is connected with a scan line 12, and a terminal of a source is connected with a pixel electrode, and another terminal is connected with a storage capacitor Cst. Another terminal of the storage capacitor Cst is connected with a common electrode. The voltage of the common electrode is designated VCOM. For an IPS or FFS mode, VCOM is located at an array substrate. For a VA or TN mode, VCOM is located at a color filter substrate. A deflection angle of liquid crystal molecules is determined by a voltage difference of a pixel electrode and a common electrode, and brightness (gray-scale value) of the pixel is thus determined.

In general, the common electrode is applied with a direct current (DC) or alternating current (AC) driving, and usually the direct current will be driving. A direct current potential of the common electrode is obtained by rectifying the alternating current, so this would inevitably lead to the presence of an amount of alternating current which is not filtered out. In addition, a wave of a direct current signal is generated caused by a load variation driven by the potential or environment (charging or electromagnetic interference), and the slight wave is called a ripple.

FIG. 2 is a diagram showing an output section of a common voltage generating module. There will usually be outputted through a voltage follower, which is used for performing a buffered isolation. A common voltage is inputted into an anode input terminal of the voltage follower 14. A output terminal of the voltage follower 14 is grounded through a resistance R and a capacitor C so as to remove the alternating current. A processed common voltage 15 is connected to another terminal of the storage capacitor Cst. The outputted waveform generally comprises an alternating ripple. For VCOM, the ripple will be changed over time, so the voltage for applying to the pixel will be changed. Thus, when a frame is displayed by the LCD, the pixel voltage at two adjacent rows will different, thereby producing a cross-talk phenomenon.

Accordingly, it is necessary to provide a voltage regulation circuit to solve the technical problem in the prior art.

SUMMARY OF THE INVENTION

An object of the present invention is to provide a voltage regulation circuit so as to solve the problems that dark lines appear in the display panel since the common electrode voltage is unstable.

In order to solve the above-mentioned problems, the present invention provides a voltage regulation circuit, wherein the voltage regulation circuit is used for a liquid crystal display panel, comprises:

a common voltage generating module for providing a first initial voltage to a common electrode, the first initial voltage comprising an AC voltage and a DC voltage, the common voltage generating module having a first output terminal which is used for outputting the first initial voltage to the common electrode;

an inputting module, for inputting a second initial voltage into a pixel, including a second output terminal which is used for outputting the second initial voltage;

a reverse processing module, for processing the first initial voltage of the common voltage generating module so as to obtain a reverse voltage of the AC voltage, including a first input terminal and a third output terminal, the first initial voltage being inputted into the first input terminal, the third output terminal being used for outputting the reverse voltage of the AC voltage, the reverse processing module including a DC blocking unit which is used for removing the DC voltage of the first initial voltage inputted by the first input terminal; and an integration module for regulating the first initial voltage according to the reverse voltage of the AC voltage so as to make a liquid crystal drive voltage equal to a preset value, the liquid crystal drive voltage being a difference value of between the second initial voltage and the first initial voltage which is regulated, the integration module having a second input terminal and a fourth output terminal, the reverse voltage of the AC voltage and the first initial voltage being inputted into the second input terminal, the fourth output terminal being used for outputting the liquid crystal drive voltage, wherein the integration module comprises a fourth resistance, a fifth resistance, a sixth resistance, a second differential amplifier, and a second capacitor;

the second differential amplifier comprises a second initial input terminal, a second feedback input terminal, and a second differential output terminal;

the first input terminal is also connected with the second input terminal via the sixth resistance, the second initial input terminal is connected with the second input terminal, the second feedback input terminal is grounded through the fourth resistance;

the second differential output terminal is connected with the second feedback input terminal via the fifth resistance;

the second differential output terminal is connected with the fourth output terminal, the second differential output terminal is also grounded through the second capacitor; and the first output terminal is connected with the first input terminal, the second input terminal is connected with the first output terminal and the third output terminal, the second output terminal is connected with the fourth output terminal, and the liquid crystal display panel comprises a plurality of pixels and the common electrode.

In the voltage regulation circuit of the present invention, the reverse processing module further comprises a feedback unit which is used for reversely processing the AC voltage.

In the voltage regulation circuit of the present invention, the reverse processing module comprises a first resistance, a second resistance, a third resistance, a first differential amplifier, and a first capacitor;

the first differential amplifier comprises a first initial input terminal, a first feedback input terminal, and a first differential output terminal;

the first input terminal is connected with a terminal of the first capacitor, and another terminal of the first capacitor is connected with a terminal of the first resistance, and another terminal of the first resistance is connected with the first initial input terminal, the first feedback input terminal is grounded; and the first differential output terminal is connected with the first initial input terminal via the second resistance, and the first differential output terminal is connected with the second input terminal via the third resistance.

In order to solve the above-mentioned problems, the present invention provides a voltage regulation circuit used for a liquid crystal display panel, comprising:

a common voltage generating module for providing a first initial voltage to a common electrode, the first initial voltage comprising an AC voltage and a DC voltage;

an inputting module for inputting a second initial voltage into a pixel;

a reverse processing module for processing the first initial voltage of the common voltage generating module so as to obtain a reverse voltage of the AC voltage; and an integration module for regulating the first initial voltage according to the reverse voltage of the AC voltage so as to make a liquid crystal drive voltage equal to a preset value, the liquid crystal drive voltage being a difference value of between the second initial voltage and the first initial voltage which is regulated, wherein the liquid crystal display panel comprises a plurality of pixels and the common electrode.

In the voltage regulation circuit of the present invention, the common voltage generating module comprises a first output terminal which is used for outputting the first initial voltage to the common electrode;

the inputting module comprises a second output terminal which is used for outputting the second initial voltage;

the reverse processing module comprises a first input terminal and a third output terminal, the first initial voltage is inputted into the first input terminal, the third output terminal is used for outputting the reverse voltage of the AC voltage; and the integration module comprises a second input terminal and a fourth output terminal, the reverse voltage of the AC voltage and the first initial voltage are inputted into the second input terminal, the fourth output terminal is used for outputting the liquid crystal drive voltage, the first output terminal is connected with the first input terminal, the second input terminal is connected with the first output terminal and the third output terminal, the second output terminal is connected with the fourth output terminal.

In the voltage regulation circuit of the present invention, the reverse processing module comprises:

a DC blocking unit for removing the DC voltage of the first initial voltage inputted by the first input terminal; and a feedback unit for reversely processing the AC voltage.

In the voltage regulation circuit of the present invention, the reverse processing module comprises a first resistance, a second resistance, a third resistance, a first differential amplifier, and a first capacitor;

the first differential amplifier comprises a first initial input terminal, a first feedback input terminal, and a first differential output terminal;

the first input terminal is connected with a terminal of the first capacitor, and another terminal of the first capacitor is connected with a terminal of the first resistance, and another terminal of the first resistance is connected with the first initial input terminal, the first feedback input terminal is grounded; and the first differential output terminal is connected with the first initial input terminal via the second resistance, and the first differential output terminal is connected with the second input terminal via the third resistance.

In the voltage regulation circuit of the present invention, the integration module comprises a fourth resistance, a fifth resistance, a sixth resistance, a second differential amplifier, and a second capacitor;

the second differential amplifier comprises a second initial input terminal, a second feedback input terminal, and a second differential output terminal;

the first input terminal is also connected with the second input terminal via the sixth resistance, the second initial input terminal is connected with the second input terminal, the second feedback input terminal is grounded through the fourth resistance;

the second differential output terminal is connected with the second feedback input terminal via the fifth resistance;

the second differential output terminal is connected with the fourth output terminal, the second differential output terminal is also grounded through the second capacitor.

In the voltage regulation circuit of the present invention, the reverse processing module comprises:

a DC blocking unit for removing the DC voltage of the first initial voltage inputted by the first input terminal; and a feedback unit for reversely processing the AC voltage;

the integration module comprises a fourth resistance, a fifth resistance, a sixth resistance, a second differential amplifier, and a second capacitor;

the second differential amplifier comprises a second initial input terminal, a second feedback input terminal, and a second differential output terminal;

the first input terminal is also connected with the second input terminal via the sixth resistance, the second initial input terminal is connected with the second input terminal, the second feedback input terminal is grounded through the fourth resistance;

the second differential output terminal is connected with the second feedback input terminal via the fifth resistance;

the second differential output terminal is connected with the fourth output terminal, the second differential output terminal is also grounded through the second capacitor.

The present invention also provides a voltage regulation circuit used for a liquid crystal display panel, comprising:

a common voltage generating module for providing a first initial voltage to a common electrode, the first initial voltage comprising an AC voltage and a DC voltage;

an inputting module for inputting a second initial voltage into a pixel;

a processing module for performing a DC blocking process on the first initial voltage of the common voltage generating module so as to obtain an alternating processing voltage; and an integration module for regulating the second initial voltage according to the alternating processing voltage so as to make a liquid crystal drive voltage equal to a preset value, the liquid crystal drive voltage being a difference value of between the second initial voltage and the first initial voltage which is regulated, wherein the liquid crystal display panel comprises a plurality of pixels and the common electrode.

In the voltage regulation circuit of the present invention, the common voltage generating module comprises a first output terminal which is used for outputting the first initial voltage to the common electrode;

the inputting module comprises a second output terminal which is used for outputting the second initial voltage;

the reverse processing module comprises a first input terminal and a third output terminal, the first initial voltage is inputted into the first input terminal, the third output terminal is used for outputting the alternating processing voltage;

the integration module comprises a second input terminal and a fourth output terminal, the alternating processing voltage and the second initial voltage are inputted into the second input terminal, the fourth output terminal is used for outputting the liquid crystal drive voltage; and the first output terminal is connected with the first input terminal, the second input terminal is connected with the second output terminal and the third output terminal, the fourth output terminal is connected with the first output terminal.

In the voltage regulation circuit of the present invention, the processing module comprises a first capacitor and a first resistance, a terminal of the first capacitor is connected with the first input terminal, and another terminal of the first capacitor is connected with the first resistance, and another terminal of the first resistance is connected with the third output terminal.

In the voltage regulation circuit of the present invention, the integration module comprises a second resistance, a third resistance, a fourth resistance, a first differential amplifier, and a second capacitor;

the first differential amplifier comprises a first initial input terminal, a first feedback input terminal, and a first differential output terminal;

the second input terminal is connected with the first initial input terminal, the second output terminal is connected with the first initial input terminal via the second resistance, the first feedback input terminal is grounded through the third resistance;

the first differential output terminal is connected with the first feedback input terminal via the fourth resistance;

a terminal of the first differential output terminal is grounded through the second capacitor, another terminal of the first differential output terminal is connected with the fourth output terminal.

In the voltage regulation circuit of the present invention, the processing module comprises a first capacitor and a first resistance, a terminal of the first capacitor is connected with the first input terminal, and another terminal of the first capacitor is connected with the first resistance, and another terminal of the first resistance is connected with the third output terminal; and the integration module comprises a second resistance, a third resistance, a fourth resistance, a first differential amplifier, and a second capacitor;

the first differential amplifier comprises a first initial input terminal, a first feedback input terminal, and a first differential output terminal;

the second input terminal is connected with the first initial input terminal, the second output terminal is connected with the first initial input terminal via the second resistance, the first feedback input terminal is grounded through the third resistance;

the first differential output terminal is connected with the first feedback input terminal via the fourth resistance;

a terminal of the first differential output terminal is grounded through the second capacitor, another terminal of the first differential output terminal is connected with the fourth output terminal.

In the voltage regulation circuit of the present invention, the integration module further comprises a fifth resistance, the first output terminal is connected with the fourth output terminal via the fifth resistance.

In the voltage regulation circuit of the present invention, a voltage at a common electrode or a voltage at an electrode of a pixel is regulated, so a difference value between two voltages is kept at a stable value, thereby eliminating a crosstalk phenomenon, and increasing the display effect.

DETAILED DESCRIPTION OF THE INVENTION

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto.

Figure 1:
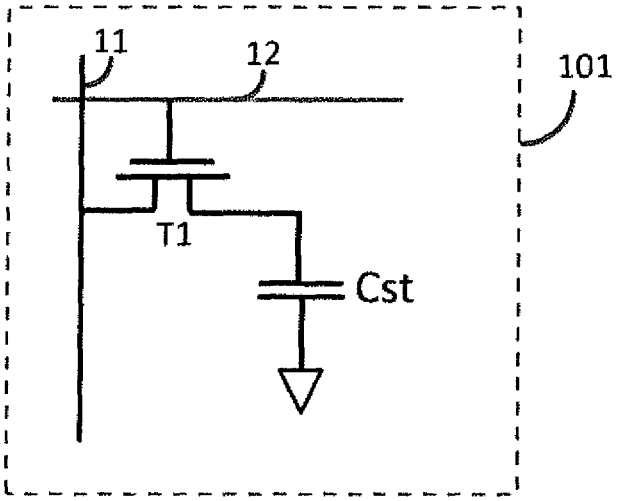
FIG. 1 is a structural diagram showing one pixel of a liquid crystal display panel.
Figure 2:
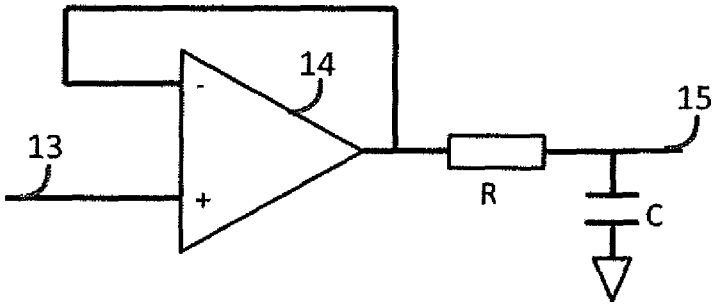
FIG. 2 is a diagram showing an output section of a common voltage generating module.
Figure 3:
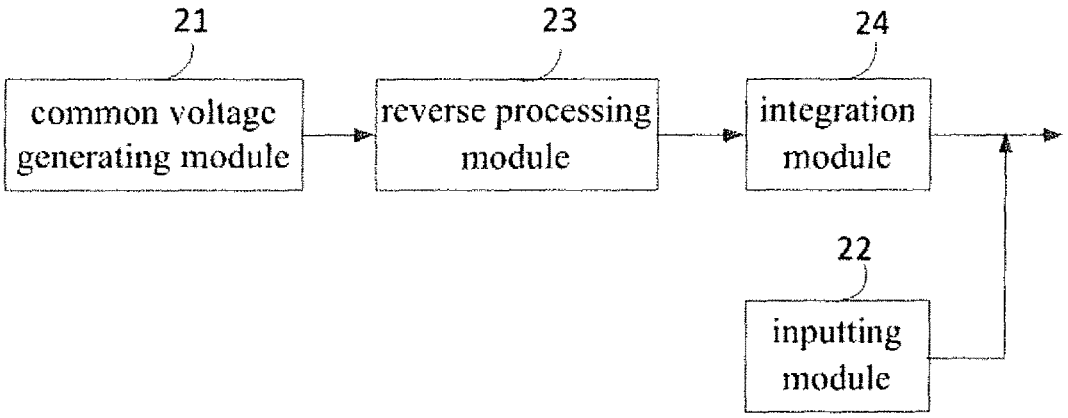
FIG. 3 is a diagram of a voltage regulation circuit of a first preferred embodiment of the present invention.

Please refer to FIG. 3, which is a diagram of a voltage regulation circuit of a first preferred embodiment of the present invention.

The voltage regulation circuit is used for a liquid crystal display panel. The liquid crystal display panel comprises a first substrate and a second substrate. The first substrate is, for example, an array substrate, and the second substrate is, for example, a color filter substrate. The first substrate comprises a plurality of data lines and a plurality of scan lines, and a plurality of pixels are defined by the data lines and scan lines. A gray-scale voltage is inputted into a pixel. The second substrate comprises a common electrode.

As show on FIG. 3, the voltage regulation circuit comprises a common voltage generating module 21, an inputting module 22, a reverse processing module 23, and an integration module 24.

The common voltage generating module 21 is used for providing a first initial voltage (i.e., an initial common voltage) to a common electrode. The first initial voltage comprises an Alternating current (AC) voltage and a Direct current (DC) voltage.

The inputting module 22 is used for outputting a second initial voltage (i.e., the gray-scale voltage) to the pixel.

The reverse processing module 23 is used for processing the first initial voltage of the common voltage generating module 21 so as to obtain a reverse voltage of the AC voltage.

The integration module 24 is used for regulating the first initial voltage according to the reverse voltage of the AC voltage so as to make a liquid crystal drive voltage equal to a preset value. The liquid crystal drive voltage is a difference value of between the second initial voltage (the gray-scale voltage of the pixel) and the first initial voltage which is regulated.

Preferably, the common voltage generating module 21 comprises a first output terminal which is used for outputting the first initial voltage to the common electrode. The inputting module 22 comprises a second output terminal which is used for outputting the second initial voltage. The reverse processing module 23 comprises a first input terminal and a third output terminal. The first initial voltage is inputted into the first input terminal. The third output terminal is used for outputting the reverse voltage of the AC voltage. The integration module 24 comprises a second input terminal and a fourth output terminal. The reverse voltage of the AC voltage and the first initial voltage are inputted into the second input terminal. The fourth output terminal is used for outputting the liquid crystal drive voltage. The first output terminal is connected with the first input terminal. The second input terminal is connected with the first output terminal and the third output terminal. The second output terminal is connected with the fourth output terminal.

The reverse processing module comprises:

A DC blocking unit is used for removing the DC voltage of the first initial voltage inputted by the first input terminal. That is, the DC voltage of the first initial voltage is removed, and the AC voltage is reserved.

A feedback unit is used for reversely processing the AC voltage.

Figure 4:
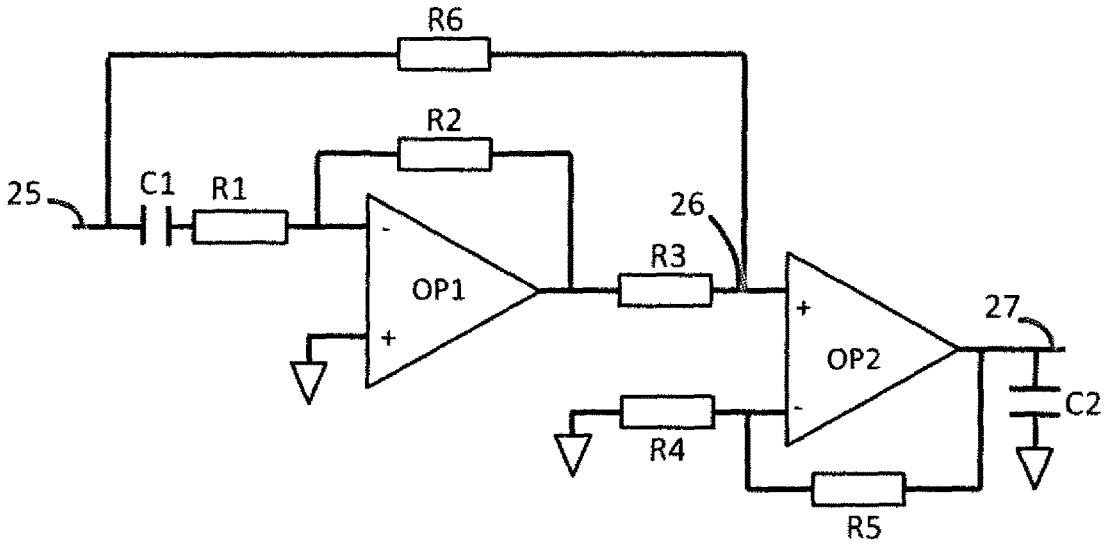
FIG. 4 is a preferred circuit diagram of FIG. 3.

As shown on FIG. 4, the reverse processing module comprises a first resistance R1, a second resistance R2, a third resistance R3, a first differential amplifier OP1, and a first capacitor C1.

The first differential amplifier OP1 comprises a first initial input terminal (cathode), a first feedback input terminal (anode), and a first differential output terminal.

The first input terminal 25 is connected with a terminal of the first capacitor C1, and another terminal of the first capacitor C1 is connected with a terminal of the first resistance R1, and another terminal of the first resistance R1 is connected with the first initial input terminal. The first feedback input terminal is grounded.

The first differential output terminal is connected with the first initial input terminal via the second resistance R2, and the first differential output terminal is connected with the second input terminal 26 via the third resistance R3.

Preferably, the integration module comprises a fourth resistance R4, a fifth resistance R5, a sixth resistance R6, a second differential amplifier OP2, and a second capacitor C2.

The second differential amplifier comprises a second initial input terminal (anode), a second feedback input terminal (cathode), and a second differential output terminal.

The first input terminal 25 is also connected with the second input terminal 26 via the sixth resistance R6. The second initial input terminal is connected with the second input terminal 26. The second feedback input terminal is grounded through the fourth resistance R4.

The second differential output terminal is connected with the second feedback input terminal via the fifth resistance R5.

The second differential output terminal is connected with the fourth output terminal 27. The second differential output terminal is also grounded through the second capacitor C2. Preferably, R1=R2, and R3=R4=R5=R6.

In this embodiment, the DC blocking process is applied on the initial voltage of the common electrode and then the AC voltage is reversely processed so as to obtain the reverse AC voltage, and then which is superposed with the initial voltage, thereby removing the AC voltage at the common electrode. In general, since the pixel voltage is constant, the corresponding gray-scale drive voltage is constant under the situation that the common voltage is constant, thereby eliminating a crosstalk phenomenon.

Figure 5:
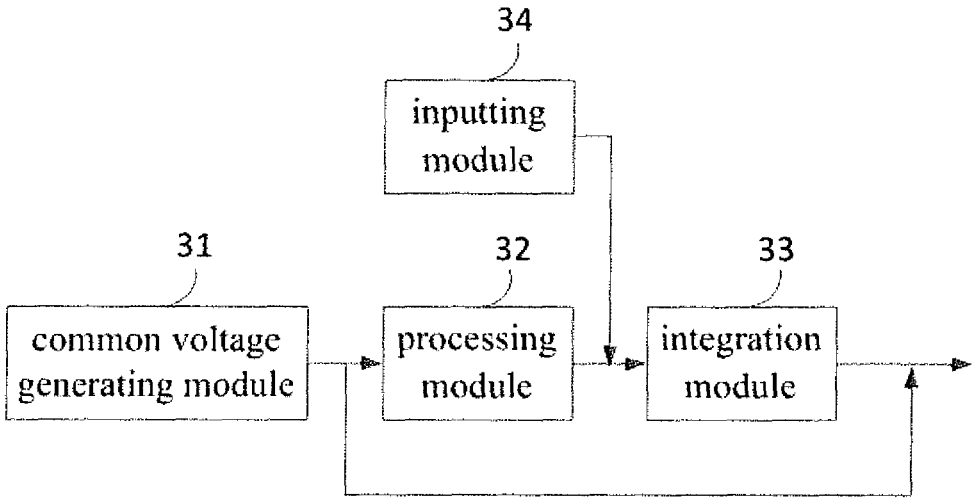
FIG. 5 is a diagram of a voltage regulation circuit of a second preferred embodiment of the present invention.

Please refer to FIG. 5, which is a diagram of a voltage regulation circuit of a second preferred embodiment of the present invention.

As shown on FIG. 5, the present invention further provides a voltage regulation circuit, comprising: a common voltage generating module 31, an inputting module 34, a processing module 32, and an integration module 33.

The common voltage generating module 31 is used for providing a first initial voltage to a common electrode. The first initial voltage comprises an AC voltage and a DC voltage.

The inputting module 34 is used for inputting a second initial voltage (gray-scale voltage) into a pixel.

The processing module 32 is used for performing a DC blocking process on the first initial voltage of the common voltage generating module so as to obtain an alternating processing voltage.

The integration module 33 is used for regulating the second initial voltage according to the alternating processing voltage so as to make a liquid crystal drive voltage equal to a preset value. The liquid crystal drive voltage is a difference value of between the second initial voltage and the first initial voltage which is regulated.

Preferably, the common voltage generating module 31 comprises a first output terminal which is used for outputting the first initial voltage to the common electrode.

The inputting module 34 comprises a second output terminal which is used for outputting the second initial voltage.

The reverse processing module 32 comprises a first input terminal and a third output terminal. The first initial voltage is inputted into the first input terminal. The third output terminal is used for outputting the alternating processing voltage.

The integration module 33 comprises a second input terminal and a fourth output terminal. The alternating processing voltage and the second initial voltage are inputted into the second input terminal. The fourth output terminal is used for outputting the liquid crystal drive voltage.

The first output terminal is connected with the first input terminal, the second input terminal is connected with the second output terminal and the third output terminal. The fourth output terminal is connected with the first output terminal.

Figure 6:
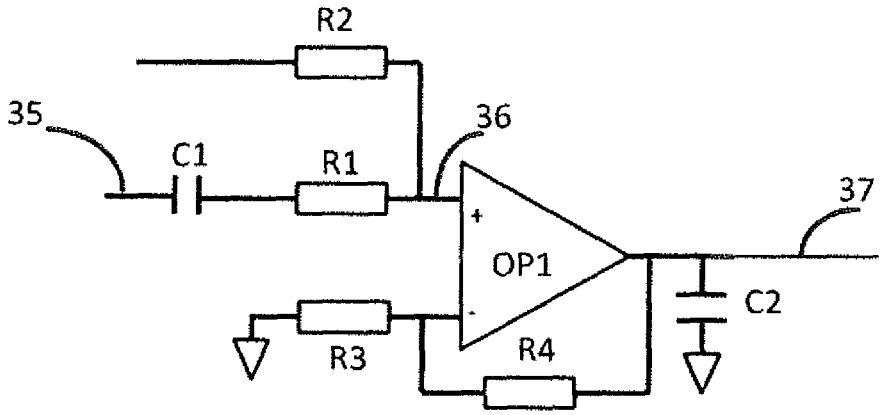
FIG. 6 is a preferred circuit diagram of FIG. 5.

Preferably, as shown on FIG. 6, the processing module 32 comprises a first capacitor C1 and a first resistance R1.

A terminal of the first capacitor C1 is connected with the first input terminal 35, and another terminal of the first capacitor C1 is connected with the first resistance R1, and another terminal of the first resistance R1 is connected with the third output terminal.

The integration module 33 comprises a second resistance R2, a third resistance R3, a fourth resistance R4, a first differential amplifier OP1, and a second capacitor C2.

The first differential amplifier OP1 comprises a first initial input terminal (anode), a first feedback input terminal (cathode), and a first differential output terminal.

The first initial input terminal is connected with the second input terminal 36. The second output terminal is connected with the first initial input terminal via the second resistance R2. The first feedback input terminal is grounded through the third resistance R3. The first feedback input terminal is also connected with the first differential output terminal via the fourth resistance R4. A terminal of the first differential output terminal is grounded through the second capacitor C2, another terminal of the first differential output terminal is connected with the fourth output terminal 37. The integration module further comprises a fifth resistance. The first output terminal is connected with the fourth output terminal 37 via the fifth resistance. Preferably, R1=R2, and R3=R4.

In this embodiment, the DC blocking process is applied on the common voltage to obtain the AC voltage, and then the AC voltage is superposed with the gray-scale voltage, so that the gray-scale voltage comprises the alternating common voltage. Since the liquid crystal drive voltage is equal to a difference value of between the gray-scale voltage and the common voltage, a ripple of the common voltage is eliminated, thereby keeping the liquid crystal drive voltage at a constant value, and eliminating a crosstalk phenomenon.

The above descriptions are merely preferred embodiments of the present invention, and are not intended to limit the scope of the present invention. Any modification or replacement made by those skilled in the art without departing from the spirit and principle of the present invention should fall within the protection scope of the present invention. Therefore, the protection scope of the present invention is subject to the appended claims.

What is claimed is:

1. A voltage regulation circuit in a liquid crystal display panel, comprising: a common voltage generating module configured to provide a first initial voltage to a common electrode, the first initial voltage comprising an Alternating current (AC) voltage and a Direct current (DC) voltage, wherein the common voltage generating module comprises a first output terminal configured to output the first initial voltage to the common electrode;

an inputting module configured to input a second initial voltage into a pixel, wherein the inputting module comprises a second output terminal configured to output the second initial voltage;

a reverse processing module configured to process the first initial voltage of the common voltage generating module so as to obtain a reverse voltage of the AC voltage, wherein the reverse processing module comprises a first input terminal and a third output terminal, wherein the first initial voltage is inputted into the first input terminal, wherein the third output terminal is configured to output the reverse voltage of the AC voltage, wherein the reverse processing module comprises a DC blocking unit, wherein the DC blocking unit is configured to remove the DC voltage of the first initial voltage inputted by the first input terminal; and an integration module configured to regulate the first initial voltage according to the reverse voltage of the AC voltage so as to make a liquid crystal drive voltage equal to a preset value, wherein the liquid crystal drive voltage is a difference value of between the second initial voltage and the first initial voltage, wherein the integration module comprises a second input terminal and a fourth output terminal, wherein the reverse voltage of the AC voltage and the first initial voltage are inputted into the second input terminal, the fourth output terminal is configured to output the liquid crystal drive voltage, wherein the integration module comprises a fourth resistance, a fifth resistance, a sixth resistance, a second differential amplifier, and a second capacitor; the second differential amplifier comprises a second initial input terminal, a second feedback input terminal, and a second differential output terminal; the first input terminal is further connected with the second input terminal via the sixth resistance, the second initial input terminal is connected with the second input terminal, the second feedback input terminal is grounded through the fourth resistance; the second differential output terminal is connected with the second feedback input terminal via the fifth resistance; the second differential output terminal is connected with the fourth output terminal, the second differential output terminal is further wounded through the second capacitor; and the first output terminal is connected with the first input terminal, the second input terminal is connected with the first output terminal and the third output terminal, the second output terminal is connected with the fourth output terminal; and the liquid crystal display panel comprises a plurality of pixels and the common electrode, wherein the reverse processing module comprises a first resistance, a second resistance, a third resistance, a first differential amplifier, and a first capacitor; the first differential amplifier comprises a first initial input terminal, a first feedback input terminal, and a first differential output terminal; the first input terminal is connected with a terminal of the first capacitor, and another terminal of the first capacitor is connected with a terminal of the first resistance, and another terminal of the first resistance is connected with the first initial input terminal, the first feedback input terminal is grounded; and the first differential output terminal is connected with the first initial input terminal via the second resistance, and the first differential output terminal is connected with the second input terminal via the third resistance.

2. The voltage regulation circuit as claimed in claim 1, wherein the reverse processing module further comprises a feedback unit, wherein the feedback unit is configured to reversely process the AC voltage.

* * * * *